US009442435B2

(12) United States Patent
Miyauchi

(10) Patent No.: US 9,442,435 B2
(45) Date of Patent: Sep. 13, 2016

(54) FIXING DEVICE, IMAGE FORMING APPARATUS AND FIXING METHOD

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Chie Miyauchi, Kanagawa (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 5 days.

(21) Appl. No.: 14/505,652

(22) Filed: Oct. 3, 2014

(65) Prior Publication Data

US 2016/0097997 A1 Apr. 7, 2016

(51) Int. Cl.
*G03G 15/20* (2006.01)

(52) U.S. Cl.
CPC ..... *G03G 15/2025* (2013.01); *G03G 15/2053* (2013.01)

(58) Field of Classification Search
None
See application file for complete search history.

(56) References Cited

U.S. PATENT DOCUMENTS

| | | | | |
|---|---|---|---|---|
| 8,718,525 | B2 | 5/2014 | Kikuchi | |
| 2008/0124111 | A1* | 5/2008 | Baba | G03G 15/2039 399/69 |
| 2010/0247183 | A1* | 9/2010 | Haseba | G03G 15/2064 399/329 |
| 2010/0303526 | A1* | 12/2010 | Hayase | G03G 15/206 399/329 |

* cited by examiner

*Primary Examiner* — David Gray
*Assistant Examiner* — Geoffrey T Evans
(74) *Attorney, Agent, or Firm* — Amin, Turocy & Watson LLP

(57) ABSTRACT

In accordance with one embodiment, a fixing device comprises a pressing roller configured to be rotationally driven by a motor; an endless fixing belt configured to be driven to rotate through the rotation of the pressing roller; a fixing pad configured to be contacted with the inner periphery of the fixing belt and be pressed against the pressing roller to form a fixing nip; a lubricant configured to be coated on the inner peripheral surface of the fixing belt; an exciting coil configured to generate a magnetic field; a magnetic shunt alloy member configured to abut along one part of the inner peripheral surface of the fixing belt; a shield member configured to face the inner side of the magnetic shunt alloy member; and a flow-out prevention section configured to prevent the lubricant from flowing into a gap between the magnetic shunt alloy member and the shield member.

9 Claims, 8 Drawing Sheets

FIXING DEVICE, IMAGE FORMING APPARATUS AND FIXING METHOD

FIELD

Embodiments described herein relate general to a fixing device which heats and fixes toner through electromagnetic induction, an image forming apparatus and a fixing method.

BACKGROUND

Conventionally, in a fixing device which carries out heating processing through electromagnetic induction (IH), a magnetic shunt alloy and a shield are arranged in a fixing belt in a noncontact manner. However, in this case, there is a problem that the temperature of a fixing member is low in a continuous printing processing due to the low heat capacity and a problem that the temperature distribution is uneven in the longitudinal direction of the fixing device. Thus, there is a fixing device in which the magnetic shunt alloy and the shield are arranged to sequentially contact with the inner surface of the fixing belt so as to increase the heat capacity, improve the heating performance and reduce the consumption amount of power.

However, the contact between the magnetic shunt alloy and the inner surface of the fixing belt leads to a problem that the load on a rotation motor increases and a problem that a rotation gear is worn due to the increase in the rotational torque of the fixing belt.

Thus, a lubricant such as silicon oil is coated on the inner surface of the fixing belt in advance to reduce the frictional resistance. However, in a continuous fixing operation, the lubricant enters the small gap between the magnetic shunt alloy and the shield, thus, the oil left on the inner surface of the fixing belt is not enough to contribute to the rotation load reduction, which may lead to a failure due to the torque increase.

Thus, one embodiment of the present invention provides a fixing device and a fixing method for solving the foregoing problem and preventing the reduction of the lubricant coated on the inner surface of the fixing belt.

DETAILED DESCRIPTION

Figure 1:
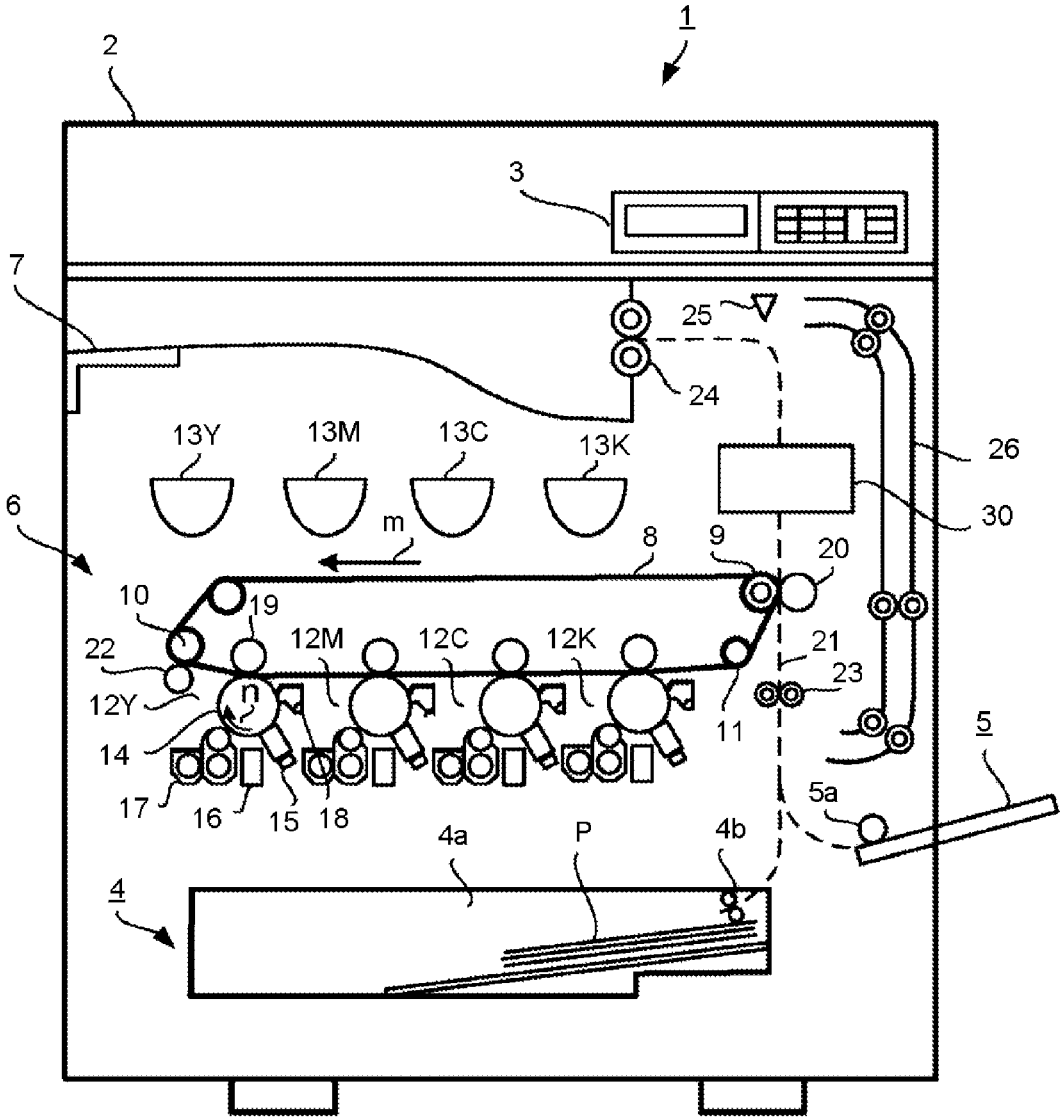
FIG. 1 is a block diagram illustrating the constitution of an image forming apparatus in which a fixing device according to a first embodiment is used.

In accordance with one embodiment, a fixing device comprises a pressing roller configured to be rotationally driven by a motor; an endless fixing belt configured to be driven to rotate through the rotation of the pressing roller; a fixing pad configured to be contacted with the inner periphery of the fixing belt and be pressed against the pressing roller to form a fixing nip; a lubricant configured to be coated on the inner peripheral surface of the fixing belt; an exciting coil configured to generate a magnetic field; a magnetic shunt alloy member configured to abut along one part of the inner peripheral surface of the fixing belt; a shield member configured to face the inner side of the magnetic shunt alloy member; and a flow-out prevention section configured to prevent the lubricant from flowing into a gap between the magnetic shunt alloy member and the shield member.

Hereinafter, embodiments are described in detail with reference to FIG. 1-FIG. 9. In the following description, the constitution components having the same function and the same constitution are indicated by the same reference numerals, and repetitive description is provided only as needed.

(A First Embodiment)

FIG. 1 is a diagram illustrating an MFP (Multi-Function Peripherals) 1 serving as one example of an image forming apparatus in which the fixing device according to the embodiment is used.

The MFP 1 exemplified in FIG. 1 includes, for example, a scanner 2, a control panel 3, a paper feed cassette section 4, a manual feeding tray 5, a printer section 6 and a paper discharge section 7.

The scanner 2 scans a document image for the image forming processing carried out by the printer section 6. The control panel 3 receives, for example, an input by a user or displays information for the user.

The paper feed cassette section 4 includes a paper feed cassette 4*a* for storing a sheet P serving as an image receiving medium and a pickup roller 4*b* for picking up the sheet P from the paper feed cassette 4*a*. The sheet P includes an unused (new) sheet or a reusable sheet (for example, a sheet the image on which is erased through color erasing processing) and the like. The manual feeding tray 5 is capable of feeding an unused (new) sheet or a reusable sheet P through a pickup roller 5*a*.

The printer section 6 includes an intermediate transfer belt 8. The printer section 6 supports the intermediate transfer belt 8 with a backup roller 9 provided with a driving section, a driven roller 10 and a tension roller 11 and rotates the intermediate transfer belt 8 in a direction indicated by an arrow m.

The printer section 6 includes Y (yellow), M (magenta), C (cyan) and K (black) image forming stations 12Y, 12M, 12C and 12K which are arranged side by side below the intermediate transfer belt 8. The printer section 6 includes replenishing cartridges 13Y, 13M, 13C and 13K for storing toner for replenishment above each of the image forming stations 12Y, 12M, 12C and 12K.

For example, the Y (yellow) image forming station 12Y includes an electrostatic charger 15, an exposure scanning head 16, a developing, device 17 and a photoconductor cleaner 18 around a photoconductive drum 14 which rotates in a direction indicated by an arrow n. The Y (yellow) mage forming station 12Y includes a primary transfer roller 19 at a position facing the photoconductive drum 14 across the intermediate transfer belt 8.

The M (magenta), C (cyan) and K (black) image forming stations 12M, 12C and 12K are structurally identical to the Y (yellow) image forming station 12Y, thus, the detailed descriptions of the constitutions of the M (magenta), C (cyan) and K (black) image forming stations 12M, 12C and 12K are omitted.

In each image forming station 12Y, 12M, 12C or 12K, the photoconductive drum 14 is exposed by the exposure scanning head 16 after being charged by the electrostatic charger 15, in this way, an electrostatic latent image is formed on each photoconductive drum 14. The developing device 17 develops the electrostatic latent image on the photoconductive drum 14 with two-component developing agent including carrier and the Y (yellow), M (magenta), C (cyan) or K (black) toner. The toner used in the development may be, for example, inerasable toner or erasable toner which can be erased by, for example, heating to a temperature higher than a given color erasing temperature.

The primary transfer roller 19 primarily transfers the toner image formed on the photoconductive drum 14 to the intermediate transfer belt 8. Each image forming station 12Y, 12M, 12C or 12K sequentially overlaps the Y (yellow), M (magenta), C (cyan) and K (black) toner images on the intermediate transfer belt 8 through the primary transfer roller 19 to form a color toner image on the intermediate transfer belt 8. The photoconductor cleaner 18 removes the toner left on the photoconductive drum 14 after the primary transfer.

The printer section 6 includes a secondary transfer roller 20 at a position facing the backup roller 9 across the intermediate transfer belt 8. The secondary transfer roller 20 secondarily transfers the color toner image on the intermediate transfer belt 8 to the sheet P collectively. The sheet P is fed from the paper feed cassette section 4 or the manual feeding tray 5 along a conveyance path 21 in synchronization with the formation of the color toner image on the intermediate transfer belt 8. A belt cleaner 22 removes the toner left on the intermediate transfer belt 8 after the secondary transfer.

The printer section 6 includes a register roller 23, a fixing device 30 and a paper discharge roller 24 along the conveyance path 21. The printer section 6 includes a branch section 25 and a reversal conveyance section 26 at the downstream side of the fixing device 30. The branch section 25 guides the sheet P subjected to fixing processing to the paper discharge section 7 or the reversal conveyance section 26. In a case of duplex printing, the reversal conveyance section 26 reversely conveys the sheet P guided by the branch section 25 to the direction of the register roller 23.

The intermediate transfer belt 8, the image forming stations 12Y, 12M, 12C and 12K and the secondary transfer roller 20 constitute an image forming section.

With the constitution described above, the MFP 1 forms a toner image corresponding to the document image read by the scanner 2 on the sheet P with the fixing device 30, and then discharges the sheet P to the paper discharge section 7.

Figure 2:
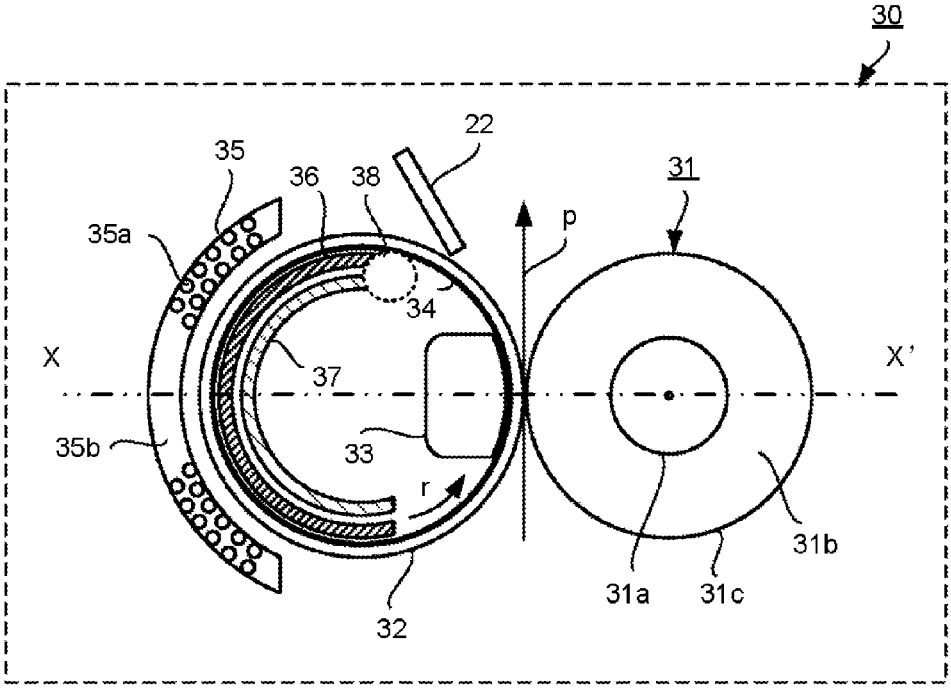
FIG. 2 is a schematic constitution diagram illustrating the fixing device according to the same embodiment viewed from the lateral side of a rotation shaft.
Figure 3:
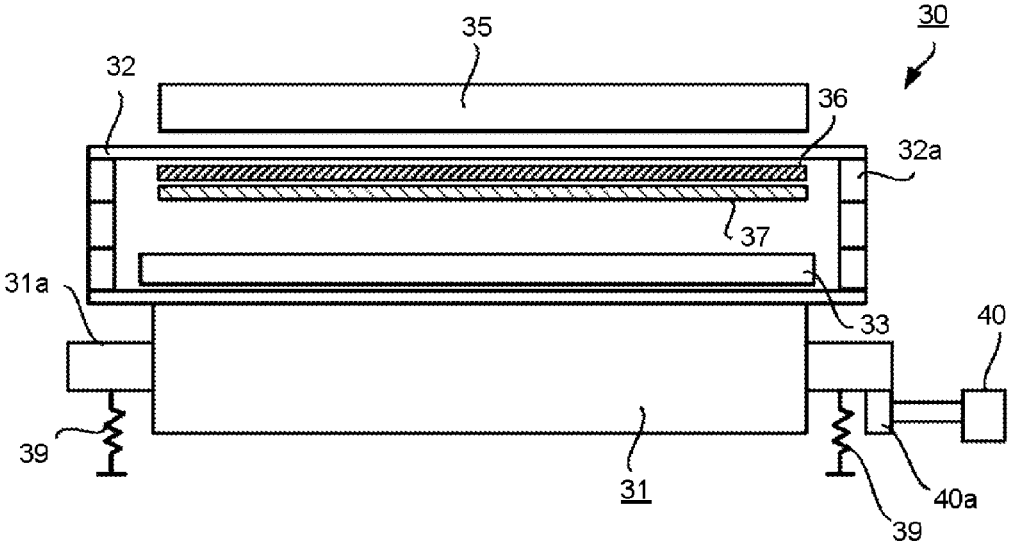
FIG. 3 is a schematic constitution diagram illustrating the fixing device according to the same embodiment viewed from a longitudinal cross-sectional direction.

Next, the fixing device 30 according to the present embodiment is described in detail. FIG. 2 is a schematic constitution diagram of the fixing device 30 viewed from lateral side (rotation shaft direction), and FIG. 3 is a schematic constitution diagram of the fixing device 30 viewed from an X-X' cross section (longitudinal direction).

As shown in FIG. 2, the fixing device 30 includes a pressing roller 31 which is rotationally driven, an endless fixing belt 32 which is driven to rotate through the rotation of the pressing roller 31, a fixing pad 33 which is contacted with the inner periphery of the fixing belt 32 and is pressed against the pressing roller 31 to form a fixing nip, a lubricant 34 coated at the inner peripheral surface of the fixing belt 32, an exciting coil unit 35 for generating a magnetic field, a magnetic shunt alloy member 36 arranged to abut along one part of the inner peripheral surface of the fixing belt 32, a shield member 37 arranged to abut along the inner side of the magnetic shunt alloy member 36 in the overlapped manner, and a flow-out prevention structure 38 (indicated by a dotted circle) for preventing the lubricant 34 from flowing into the space between the magnetic shunt alloy member 36 and the shield member 37. In addition, though the fixing belt 32 is contacted with the magnetic shunt alloy member 36, and the magnetic shunt alloy member 36 is further contacted with the shield member 37, in fact, small gaps exist therebetween. For the sake of the convenience of description, the gap shown in FIG. 2-FIG. 9 is widened.

The pressing roller 31 includes, for example, an elastic layer 31*b* such as a heat-resistant rubber layer around a core bar 31*a*, and a release layer 31*c* including fluorocarbon resin and the like on the surface of the elastic layer 31*b*. As shown in FIG. 3, the pressing roller 31 is contacted with the fixing belt 32 in pressure under the pressure force of a pressure spring 39. In the fixing device 30, the pressing roller 31 is rotationally driven by a motor 40 through a gear 40*a*, and the fixing belt 32 is driven to rotate through the rotation of the pressing roller 31. In FIG. 2, the rotation direction of the fixing belt 32 is indicated by an arrow.

The fixing device 30 is provided with a peeling guide 22 the front end of which is arranged close to the fixing belt 32.

The fixing pad 33, the magnetic shunt alloy member 36 and the shield member 37 formed with a material such as aluminum and the like are supported inside the fixing belt 32, and these components do not rotate. Further, wheels 32*a* for maintaining the shape of the fixing belt 32 at a substantially circular shape are arranged at the inner periphery of the two ends of the fixing belt 32. Further, a temperature sensor (not shown) for detecting the temperature of the fixing belt 32 and a thermostat (not shown) for detecting the abnormal heating of the fixing belt 32 are arranged inside the circle of the fixing belt 32.

The fixing belt 32 has a multilayer structure containing a conductive layer serving as a heating layer. The multilayer structure consists of, for example, an endless base material, the conductive layer, an elastic layer, a toner release layer from the inner periphery towards the outer periphery. The base material is, for example, a polyimide sleeve having a thickness of 70 μm.

The conductive layer is, for example, a copper (Cu) layer having a thickness of 10 μm, and a conductive layer 61 includes, for example, a nickel (Ni) layer having a thickness of 0.5-1 μm and a nickel (Ni) layer having a thickness of 8 μm which nip the copper (Cu) layer. The conductive layer may also be a single layer structure of a magnetic metal such as iron (Fe), nickel (Ni), copper (Cu) and the like as long as the conductive layer can generate heat through the magnetic field generated from the exciting coil unit 35.

The elastic layer is, for example, a silicon (Si) rubber layer having a thickness of 200 μm, and the toner release layer is, for example, a fluorocarbon resin (for example, PFA resin) tube having a thickness of 30 μm. The conductive layer may be thinned to low the heat capacity so that the fixing belt 32 can carry out warming up operation rapidly.

The fixing pad 33 is positioned to face the pressing roller 31 across the fixing belt 32. The fixing pad 33 supports the inner peripheral surface of the fixing belt 32. The pressing roller 31 presses the fixing belt 32 supported by the fixing pad 33 to form a fixing nip between the fixing belt 32 and the pressing roller 31. The fixing pad 33 is formed by, for example, heat-resistant polyphenylene sulfide resin (PPS) and the like.

For example, silicon oil is coated on the inner peripheral surface of the fixing belt 32 as the lubricant 34 to reduce frictional resistance between the fixing pad 33 and the magnetic shunt alloy member 36. Further, to reduce the effect of friction, for example, fluororesin may be coated on the surface of glass fiber, alternatively, a slip sheet may be arranged between the fixing pad 33 and the fixing belt 32, in addition to the lubricant 34.

The exciting coil unit 35 includes a coil 35*a* and a core 35*b* which covers the outer periphery of the coil to limit the magnetic flux of the coil 35*a*. The exciting coil unit 35 applies high-frequency current to the coil 35*a* to generate a magnetic field towards the direction of the fixing belt 32. The conductive layer of the fixing belt 32 generates eddy current to generate heat through the magnetic flux from the exciting coil unit 35, and in this way, the fixing belt 32 is heated.

The magnetic properties of the magnetic shunt alloy member 36 change according to the temperature. When the temperature is higher than a curie point temperature, the permeability of the magnetic shunt alloy member 36 is reduced, as a result, the density of the magnetic fluxes that pass through the fixing belt 32 is reduced. In this way, the calorific value of the fixing belt 32 can be limited, and for example, the excessive temperature rise of the non-paper passing area in the fixing belt 32 can be suppressed. In a low temperature area where the temperature is lower than the curie point temperature, the magnetic shunt alloy member 36 generates heat through electromagnetic induction under the action of the magnetic field of the exciting coil unit 35 to assist the heating of the fixing belt 32.

The shield member 37 formed into an arc shape abuts along the inner peripheral surface of the magnetic shunt alloy member 36. The shield member 37 consists of, for example, nonmagnetic metal having a relatively low resistivity such as Ag (silver), Cu (copper) and Al (aluminum).

In the fixing device 30 in which the magnetic shunt alloy member 36 and the shield member 37 are contacted with the inner peripheral surface of the fixing belt 32 in sequence, about 40% of the lubricant 34 coated on the inner peripheral surface of the fixing belt 32 in the assembling processing of the fixing device 30 enters the gap between the magnetic shunt alloy member 36 and the shield member 37 during an intermittent operation which lasts for about an hour during, and in this case, it is known that the function as the lubricant cannot be fulfilled sufficiently. That is because there is almost no gap between the magnetic shunt alloy member 36 and the fixing belt 32 which is driven to rotate, thus, the lubricant 34 flows out without entering the gap.

Thus, the flow-out prevention structure 38 indicated by the dotted circle is a structure for preventing the lubricant 34 from flowing out from the inner peripheral surface of the fixing belt through the circulation rotation of the fixing belt 32, and preventing the lubricant 34 coated on the inner peripheral surface of the fixing belt 32 from being reduced.

Figure 4:
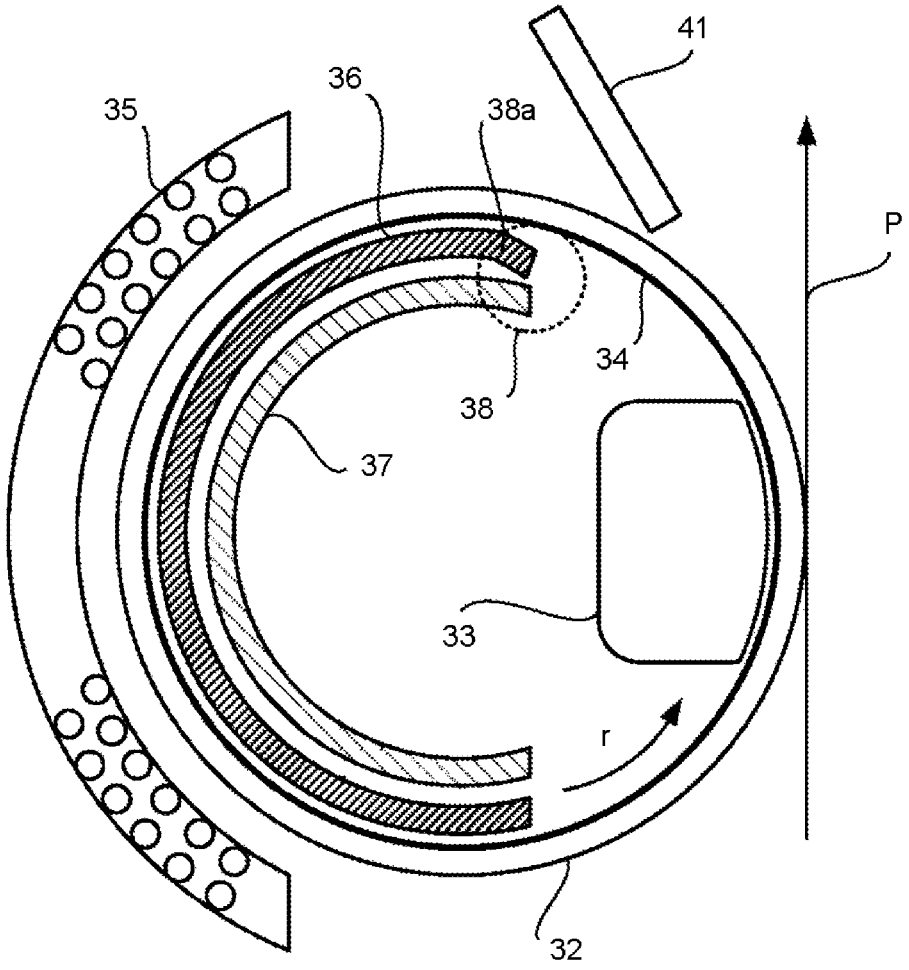
FIG. 4 is a schematic view illustrating the inner structure of a fixing belt according to the same embodiment.

FIG. 4 is a schematic view illustrating the inner structure of the fixing belt 32 according to the first embodiment. The flow-out prevention structure 38 according to the present embodiment includes a bent portion 38*a* at an upstream end of the magnetic shunt alloy member 36 in the rotation direction, and the bent portion 38*a* is formed in such a manner that the gap between the bent portion 38*a* and the fixing belt 32 is widened gradually from the inner peripheral surface of the fixing belt 32.

With the bent portion 38*a*, the lubricant 34 coated on the inner peripheral surface of the fixing belt 32 which rotates in a circle can enter the gap easily. And meanwhile, the gap between the magnetic shunt alloy member 36 and the shield member 37 is narrowed, which can reduce the flowing of the lubricant 34 into the gap.

(A Second Embodiment)

Figure 5:
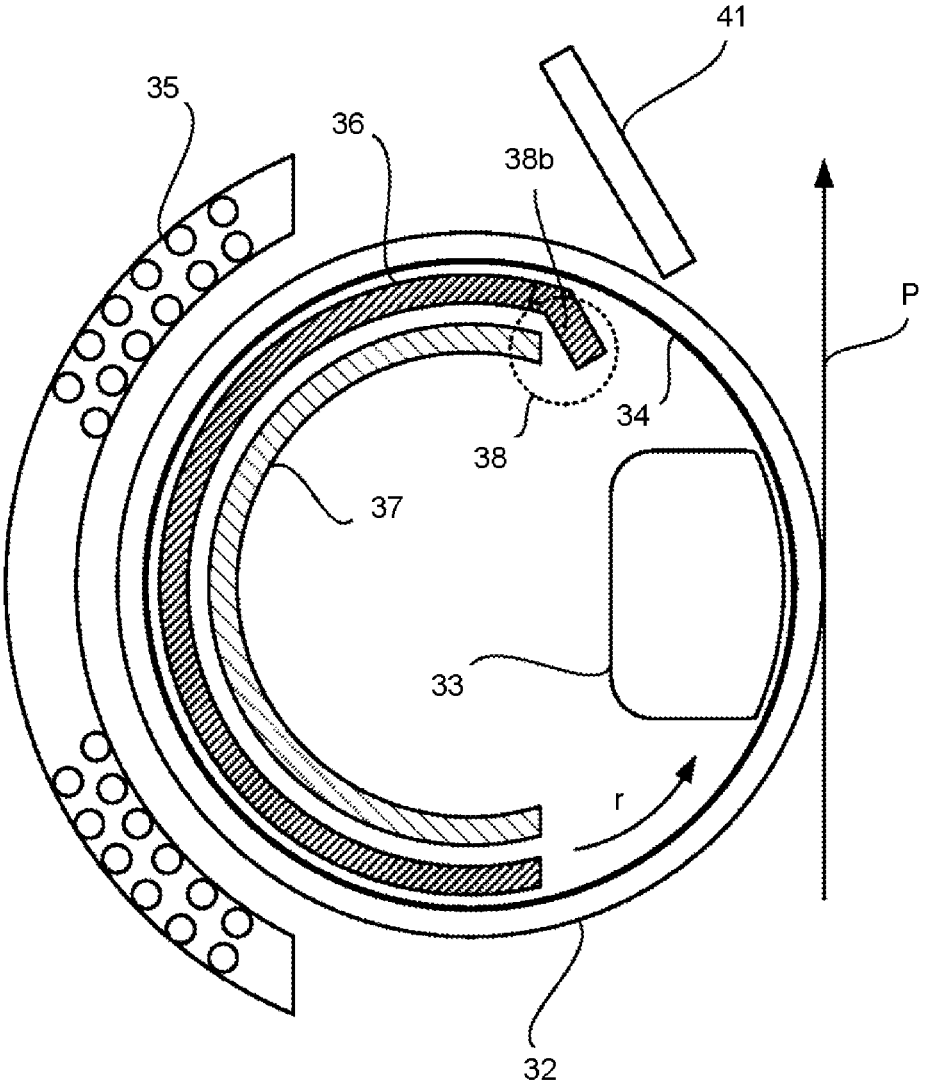
FIG. 5 is a schematic view illustrating the inner structure of a fixing belt according to a second embodiment.

FIG. 5 is a schematic view illustrating the inner structure of the fixing belt 32 according to the second embodiment. The flow-out prevention structure 38 according to the present embodiment includes a bent portion 38*b* at an upstream end of the magnetic shunt alloy member 36 in the rotation direction. The magnetic shunt alloy member 36 is extended so that the bent portion 38*b* covers the shield member 37, compared with the bent portion 38*a* shown in FIG. 4. With such a structure, the gap can be widened from the inner peripheral surface of the fixing belt 32, and meanwhile, the gap between the magnetic shunt alloy member 36 and the shield member 37 can be covered, which can reduce the flowing out of the lubricant 34 from the inner peripheral surface of the fixing belt 32. However, in a case of the present embodiment, it is necessary to consider the magnetic shunt characteristic of the magnetic shunt alloy member 36 and the shield characteristic of the shield member 37 to determine the optimal extending amount of the bent portion 38*b*. Further, it is not necessarily to extend the magnetic shunt alloy member 36 to form the bent portion 38*b*, and the bent portion 38*b* may be formed by connecting other material to the magnetic shunt alloy member 36.

(A Third Embodiment)

Figure 6:
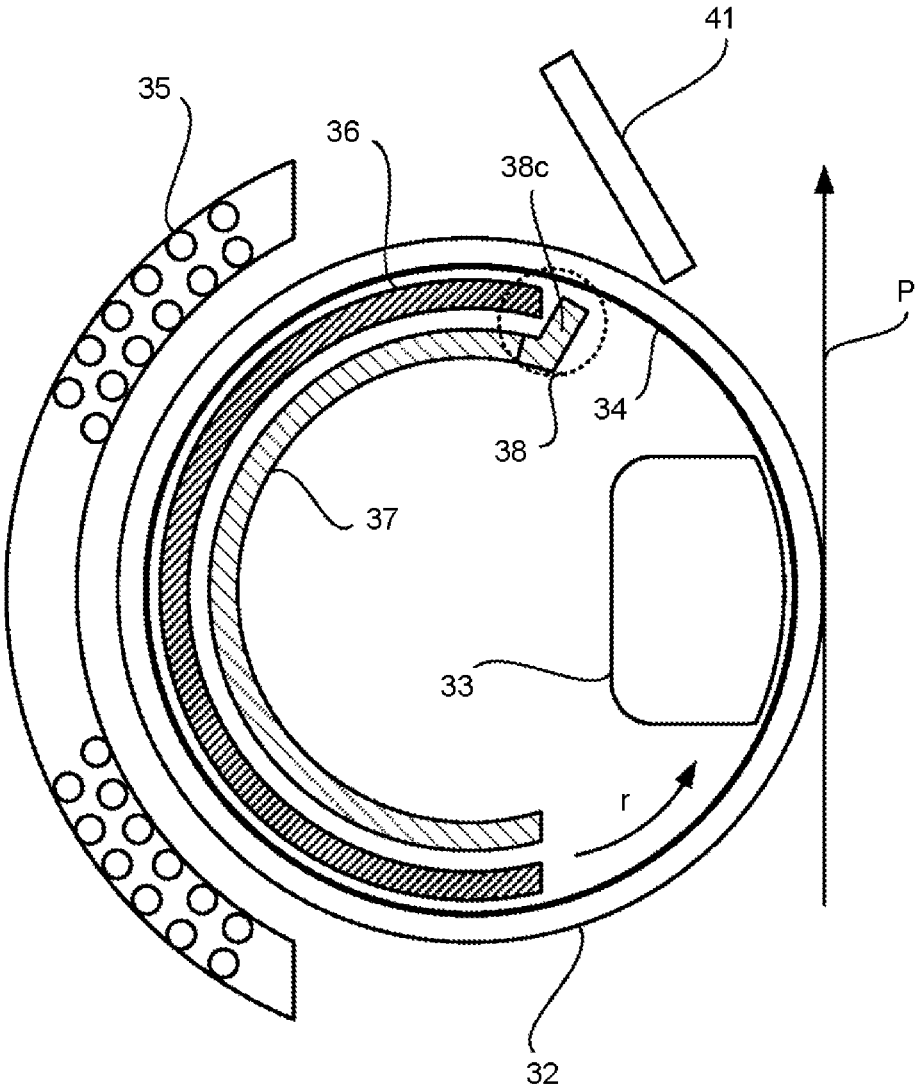
FIG. 6 is a schematic view illustrating the inner structure of a fixing belt according to a third embodiment.

FIG. 6 is a schematic view illustrating the inner structure of the fixing belt 32 according to the third embodiment. The flow-out prevention structure 38 according to the present embodiment includes a bent portion 38*c* at an upstream end of the shield member 37 in the rotation direction. Contrary to the example shown in FIG. 5, the bent portion 38*c* is formed by extending the shield member 37 to cover the magnetic shunt alloy member 36. With such a bent portion 38*c*, the gap between the magnetic shunt alloy member 36 and the shield member 37 can be covered. In this way, the flowing out of the lubricant 34 from the inner peripheral surface of the fixing belt 32 can be reduced.

(A Fourth Embodiment)

Figure 7:
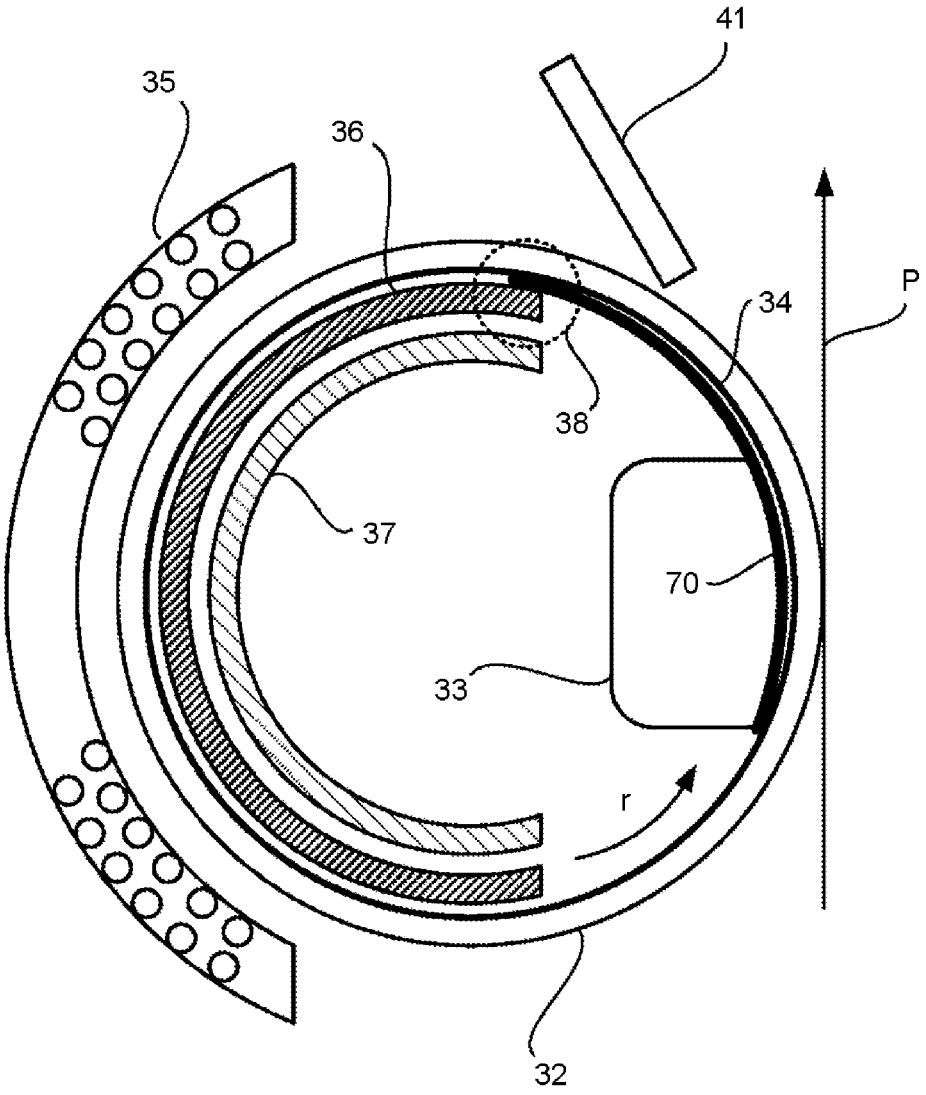
FIG. 7 is a schematic view illustrating the inner structure of a fixing belt according to a fourth embodiment.

FIG. 7 is a schematic view illustrating the inner structure of the fixing belt 32 according to the fourth embodiment. The flow-out prevention structure 38 according to the present embodiment is such a structure in which a slip sheet 70 extends to one end of the magnetic shunt alloy member 36. The end of the magnetic shunt alloy member 36 is positioned at the downstream side of a part where the fixing belt 32 contacts with the pressing roller 31, (that is, the fixing nip part) in the rotation direction of the fixing belt 32.

The lubricant 34 between the inner peripheral surface of the fixing belt 32 and the slip sheet 70 enters the gap between the inner peripheral surface of the fixing belt 32 and the magnetic shunt alloy member 36, thus, the flowing out of the lubricant 34 from the inner peripheral surface of the fixing belt 32 can be reduced.

(A Fifth Embodiment)

Figure 8:
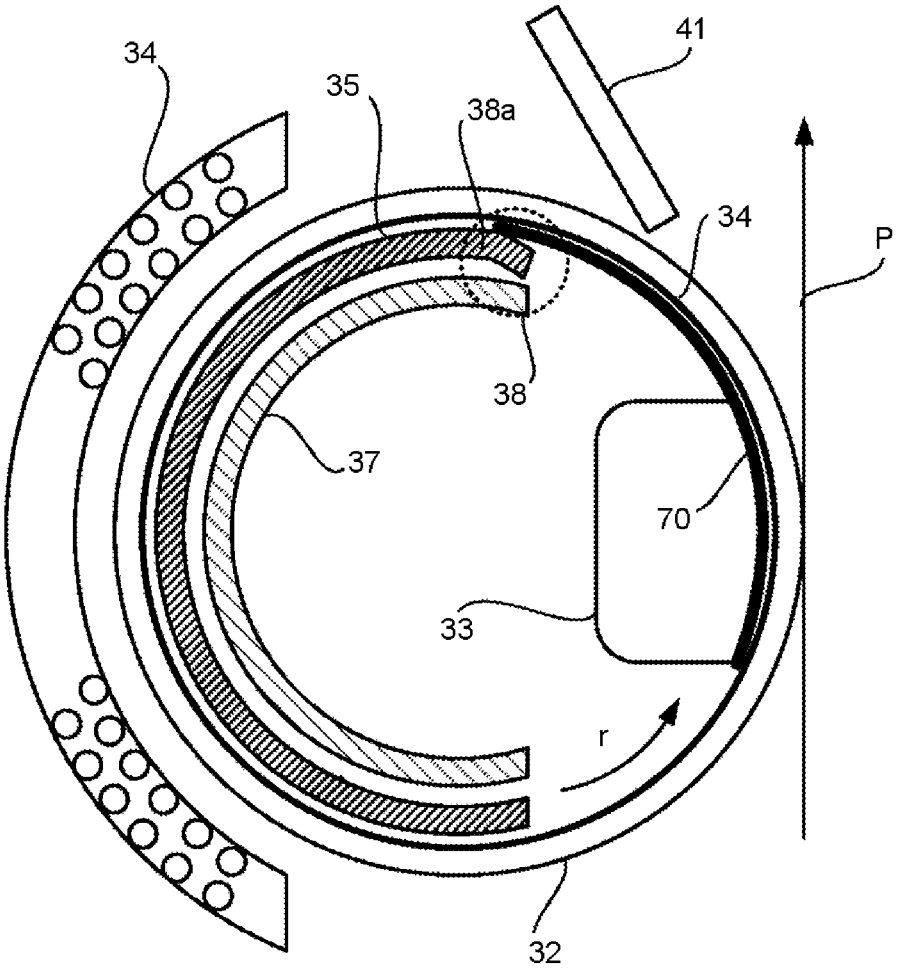
FIG. 8 is a schematic view illustrating the inner structure of a fixing belt according to a fifth embodiment.

FIG. 8 is a schematic view illustrating the inner structure of the fixing belt 32 according to the fifth embodiment. The flow-out prevention structure 38 according to the present embodiment is such a structure in which a slip sheet 70 extends to one end of the magnetic shunt alloy member 36. The end of the magnetic shunt alloy member 36 is positioned at the downstream side of a part where the fixing belt 32 contacts with the pressing roller 31, (that is, the fixing nip part) in the rotation direction of the fixing belt 32.

The first to the fourth structures are suitably combined, which can achieve a best effect to reduce flowing out of the lubricant 34 from the inner peripheral surface of the fixing belt 32.

(A Sixth Embodiment)

Figure 9:
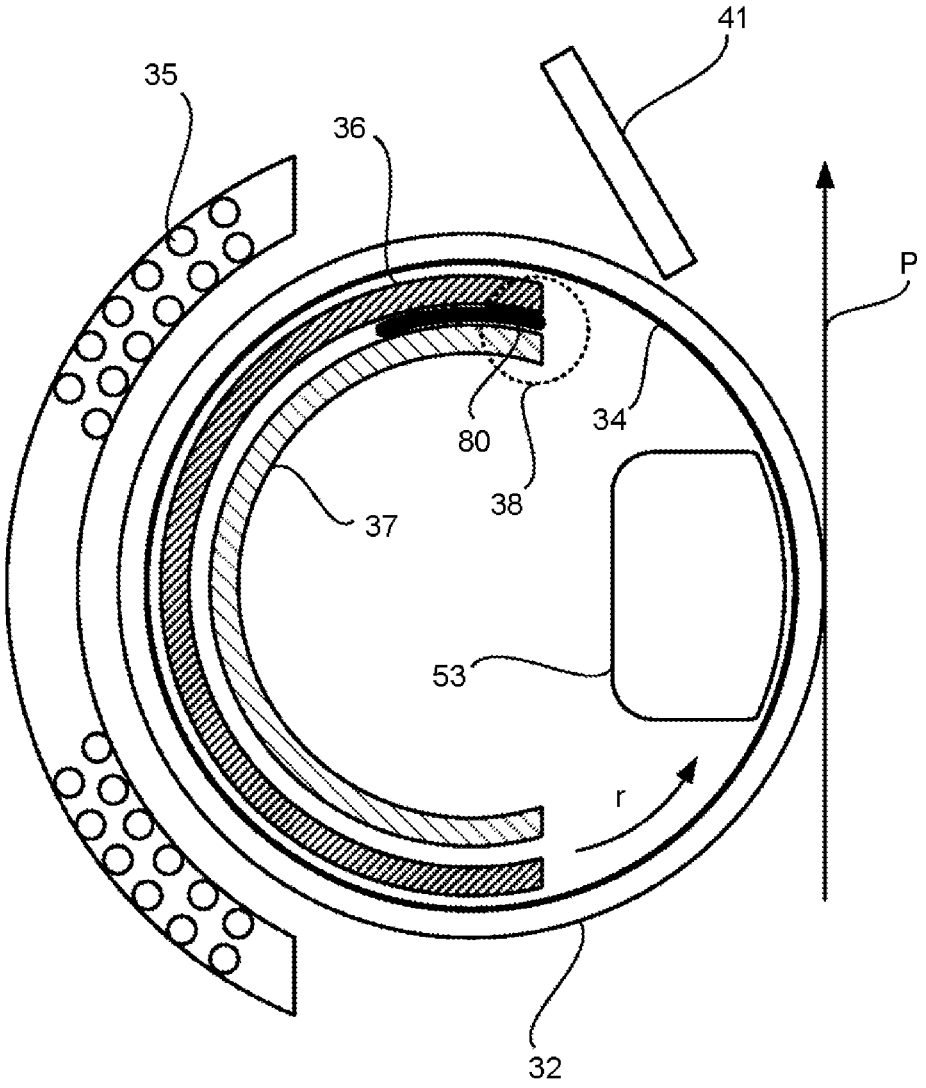
FIG. 9 is a schematic view illustrating the inner structure of a fixing belt according to a sixth embodiment.

FIG. 9 is a schematic view illustrating the inner structure of the fixing belt 32 according to the sixth embodiment. The flow-out prevention structure 38 according to the present embodiment is such a structure in which filler agent 80 is used to fill the gap between the magnetic shunt alloy member 36 and the shield member 37 at an upstream inlet in the rotation direction. The filling range and the material of the filler agent are determined with the magnetic shunt characteristic and the shield characteristic taken into consideration. In a case of a small filling range, the material of the filler agent 80 may be an adhesive or a material with high viscosity that will not affect the magnetic properties. In addition, the flow-out prevention section consists of the flow-out prevention structure 38, the bent portions 38*a*, 38*b* and 38*c*, and the end of the slip sheet 70.

The lubricant may be used as the filler agent 80, and in this case, the whole gap between the magnetic shunt alloy member 36 and the shield member 37 may be filled with the lubricant the same as the lubricant 34 in advance. In the structure in which the gap between the magnetic shunt alloy member 36 and the shield member 37 is filled with the lubricant in advance, it can be prevented that about 40% of the lubricant 34 flows into the gap between the magnetic shunt alloy member 36 and the shield member 37.

In accordance with the embodiments described above, the lubricant contributing to the rotation load reduction can be maintained on the inner peripheral surface of the fixing belt, thus, the increase in the rotational torque, the wear of the rotary gear and the excessive load on the rotation motor can be prevented, which can greatly extend the service life of the machine.

In addition, the image forming apparatus in which the fixing device according to the present embodiment is installed is not limited to the MFP. The image forming apparatus is not limited to the tandem form, and the number of the developing devices is not limited. The image forming apparatus may be such an apparatus that directly transfers the toner image to the image receiving medium from the photoconductor.

Further, the fixing device according to the present embodiment is not limited to be necessarily installed in the image forming apparatus. The fixing device according to the present embodiment may also be used in an apparatus (for example, a color erasing processing apparatus) which heats and conveys a medium.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A fixing device, comprising:

an endless fixing belt configured to be movable;

a pressing roller configured to be movable with endless fixing belt;

a fixing pad configured to be contacted with an inner periphery of the fixing belt and be pressed against the pressing roller to form a fixing nip;

a lubricant configured to be coated on an inner peripheral surface of the fixing belt;

an exciting coil configured to generate a magnetic field;

a magnetic shunt alloy member configured to abut along at least a part of the inner peripheral surface of the fixing belt;

a shield member provided to be facing the magnetic shunt alloy member and configured to shield the magnetic field generated by the exciting coil at least at an upstream end of the shield member along a moving direction of the fixing belt; and a flow-out prevention section configured to prevent the lubricant from flowing into a gap between the magnetic shunt alloy member and the shield member, wherein the magnetic shunt alloy member includes a bent portion that widens a gap between the magnetic shunt alloy member and the fixing belt, and narrows the gap between the magnetic shunt alloy member and the shield member.

2. The fixing device according to claim 1, wherein the flow-out prevention section includes a bent portion at an upstream end of either the magnetic shunt alloy member or the shield member in the moving direction of the endless fixing belt.

3. The fixing device according to claim 1, wherein the flow-out prevention section has a structure in which a slip sheet arranged on the fixing pad is extended to the upstream gap between the fixing belt and the magnetic shunt alloy member in the moving direction of the endless fixing belt.

4. The fixing device according to claim 1, wherein the flow-out prevention section is a structure in which filler agent containing a lubricant is coated in the gap between the magnetic shunt alloy member and the shield member in advance.

5. An image forming apparatus, comprising:

an image forming section configured to form an image on an image receiving medium; and a fixing device, comprising:

an endless fixing belt configured to be movable;

a pressing roller configured to be movable with the endless fixing belt;

a fixing pad configured to be contacted with an inner periphery of the fixing belt and be pressed against the pressing roller to form a fixing nip;

a lubricant configured to be coated on an inner peripheral surface of the fixing belt, an exciting coil configured to generate a magnetic field;

a magnetic shunt alloy member configured to abut along at least a part of the inner peripheral surface of the fixing belt;

a shield member provided to be facing the magnetic shunt alloy member and configured to shield the magnetic field generated by the exciting coil at least at an upstream end of the shield member along a moving direction of the fixing belt; and a flow-out prevention section configured to prevent the lubricant from flowing into a gap between the magnetic shunt alloy member and the shield member, wherein the magnetic shunt alloy member includes a bent portion that widens a gap between the magnetic shunt alloy member and the fixing belt, and narrows the gap between the magnetic shunt alloy member and the shield member, and wherein the fixing device is configured to fix the image on the image receiving medium.

6. The image forming apparatus according to claim 5, wherein the flow-out prevention section includes a second bent portion at an upstream end of either the magnetic shunt alloy member or the shield member in the moving direction of the endless fixing belt.

7. The image forming apparatus according to claim 5, wherein the flow-out prevention section has a structure in which a slip sheet arranged on the fixing pad is extended to the upstream gap between the fixing belt and the magnetic shunt alloy member in the moving direction of the endless fixing belt.

8. The image forming apparatus according to claim 5, wherein the flow-out prevention section is a structure in which filler agent containing a lubricant is coated in the gap between the magnetic shunt alloy member and the shield member in advance.

9. A fixing method, including:

rotationally driving a pressing roller;

driving an endless fixing belt to rotate through the rotation of the pressing roller;

generating a magnetic field from an exciting coil;

abutting a magnetic shunt alloy member along at least a part of an inner peripheral surface of the fixing belt to shunt the magnetic field;

arranging a shield member to face an inner side of the magnetic shunt alloy member to shield the magnetic field;

heating the fixing belt and the magnetic shunt alloy member through electromagnetic induction of the magnetic field; and contacting a fixing pad with an inner periphery of the fixing belt and pressing the fixing pad against the pressing roller to form a fixing nip, wherein a lubricant coated on the inner peripheral surface of the fixing belt is prevented from flowing into a gap between the magnetic shunt alloy member and the shield member, wherein the magnetic shunt alloy member includes a bent portion that widens a gap between the magnetic shunt alloy member and the fixing belt, and narrows the gap between the magnetic shunt alloy member and the shield member.

* * * * *